United States Patent [19]

Sherman

[11] Patent Number: 4,505,330

[45] Date of Patent: Mar. 19, 1985

[54] RADIATOR AIR INTAKE FILTERING SYSTEM

[76] Inventor: Richard W. Sherman, Rte. 2, Box 303, Chillicothe, Tex. 79225

[21] Appl. No.: 512,107

[22] Filed: Jul. 7, 1983

[51] Int. Cl.[3] ..... F01P 7/10

[52] U.S. Cl. ..... 165/119; 123/41.7; 123/41.48

[58] Field of Search ..... 165/119; 123/41.7, 41.62, 123/41.48; 180/68.6, 68.2

[56] References Cited

U.S. PATENT DOCUMENTS

| | | | |
|---|---|---|---|
| 2,455,734 | 12/1948 | Clausen | 165/119 X |
| 2,966,339 | 12/1960 | Morgan | 123/41.48 X |
| 3,446,276 | 5/1969 | Poehlman | 165/119 |

*Primary Examiner*—Allen M. Ostrager

*Attorney, Agent, or Firm*—Harvey B. Jacobson

[57] ABSTRACT

A hollow housing is provided for use in conjunction with an apparatus at least occasionally operative in a dust-laden atmosphere, having a liquid cooled combustion engine as a power source and wherein cooling liquid for the engine is passed through a heat transfer assembly in the form of an air-cooled radiator including intake and exhaust sides for cooling air. The housing includes one open side in substantially sealed communication with the intake side of the radiator and a second side of the housing remote from the one open side defines an air inlet for cooling air. Removable and replaceable air filter structure is provided in the housing between the open side thereof and the air inlet and the air inlet of the housing has the discharge end of an air duct sealingly communicated therewith. The inlet end of the air duct is supported from the vehicle in an elevated position for intaking cooling air having a minimum of dust and other foreign materials therein and the inlet end of the duct is provided with primary air filtering structure.

8 Claims, 3 Drawing Figures

RADIATOR AIR INTAKE FILTERING SYSTEM

BACKGROUND OF THE INVENTION

Some self-propelled cotton harvesters eject cotton burrs and trash from each side of the harvester and are equipped with liquid cooled engines having air cooled radiators operatively associated therewith for cooling the engine cooling liquid and such radiators each are usually mounted in close proximity to at least one side area of the corresponding harvester from which burrs and trash are ejected. This ejected material includes a considerable amount of small wisps of cotton lint originating in the burr extractor of the harvester and various forms of air borne trash and cotton lint discharged adjacent the radiator tend to quickly clog the radiator and thus reduce the liquid coolant capacity thereof.

In an attempt to deal with this problem the cotton harvester's radiator is conventionally equipped with a "squirrel cage" in the form of a rotary screen driven by an internal fan which is in turn driven by the air current generated by the radiator fan of the associated combustion engine. The rotary screen lightly contacts a stationary brush intended to wipe the screen clean. However, the wisps of cotton encountered are small enough so that a large quantity thereof passes through the rotary screen to the radiator face. In addition, the rotary screen/brush action causes some attached lint and trash to be "ground up" so that it also passes through the rotary screen to the radiator face. This causes the radiator of the engine to be blocked after only a few hours of operation causing engine overheating. Accordingly, in order to prevent engine overheating frequent removal of the "squirrel cage" and cleaning of the radiator is required.

Therefore, a need exists for structure by which the cooling air for the engine coolant radiator of a cotton harvester or the like may be effectively cleaned before passing through the radiator.

Various forms of air cleaning structures including some which are operatively associated with radiators and include some of the general structural and operational features of the instant invention are disclosed in U.S. Pat. Nos. 874,962, 1,751,739, 2,376,546, 2,455,734, 2,730,084, 2,754,809, 2,785,620, 2,896,594, 3,226,918 and 3,844,202.

BRIEF DESCRIPTION OF THE INVENTION

The radiator air intake filtering system of the instant invention includes a hollow rectangular housing including one open side mounted in at least reasonably good sealed engagement with the intake side of an associated radiator. A side of the housing remote from the open side thereof is provided with an air inlet and the interior of the housing removably supports one or more air filter elements which may be removed and cleaned or replaced with ease. The air filtering elements are operative to filter air passing through the housing from the air inlet and out the open discharge side of the housing into the inlet side of the associated radiator. An elongated air duct has its discharge end sealingly communicated with the air inlet for the housing and the inlet end of the air duct is equipped with primary air filter structure. Further, the inlet end of the air duct is supported in an elevated position in order to intake air with a minimum amount of foreign material entrained therein.

The main object of this invention is to provide a radiator air intake filtering system which will be operative to prevent the radiator of a combustion engine operating in a foreign material contaminated atmosphere from being clogged by that foreign material as the atmosphere is drawn through the radiator.

Another object of this invention is to provide a radiator air intake filtering system in accordance with the preceding objects and including air filtering elements therefor which may be readily removed and cleaned or replaced.

Still another important object of this invention is to provide a radiator air intake filtering system constructed in a manner whereby the air intake therefor may be supported in an elevated position so as to be exposed to an atmosphere having minimum foreign material contamination.

A final object of this invention to be specifically enumerated herein is to provide a radiator air intake filtering system in accordance with the preceding objects and which will conform to conventional forms of manufacture, be of simple construction and easy to use so as to provide a device that will be economically feasible, long lasting and relatively trouble free in operation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DETAILED DESCRIPTION OF THE INVENTION

Figure 1:
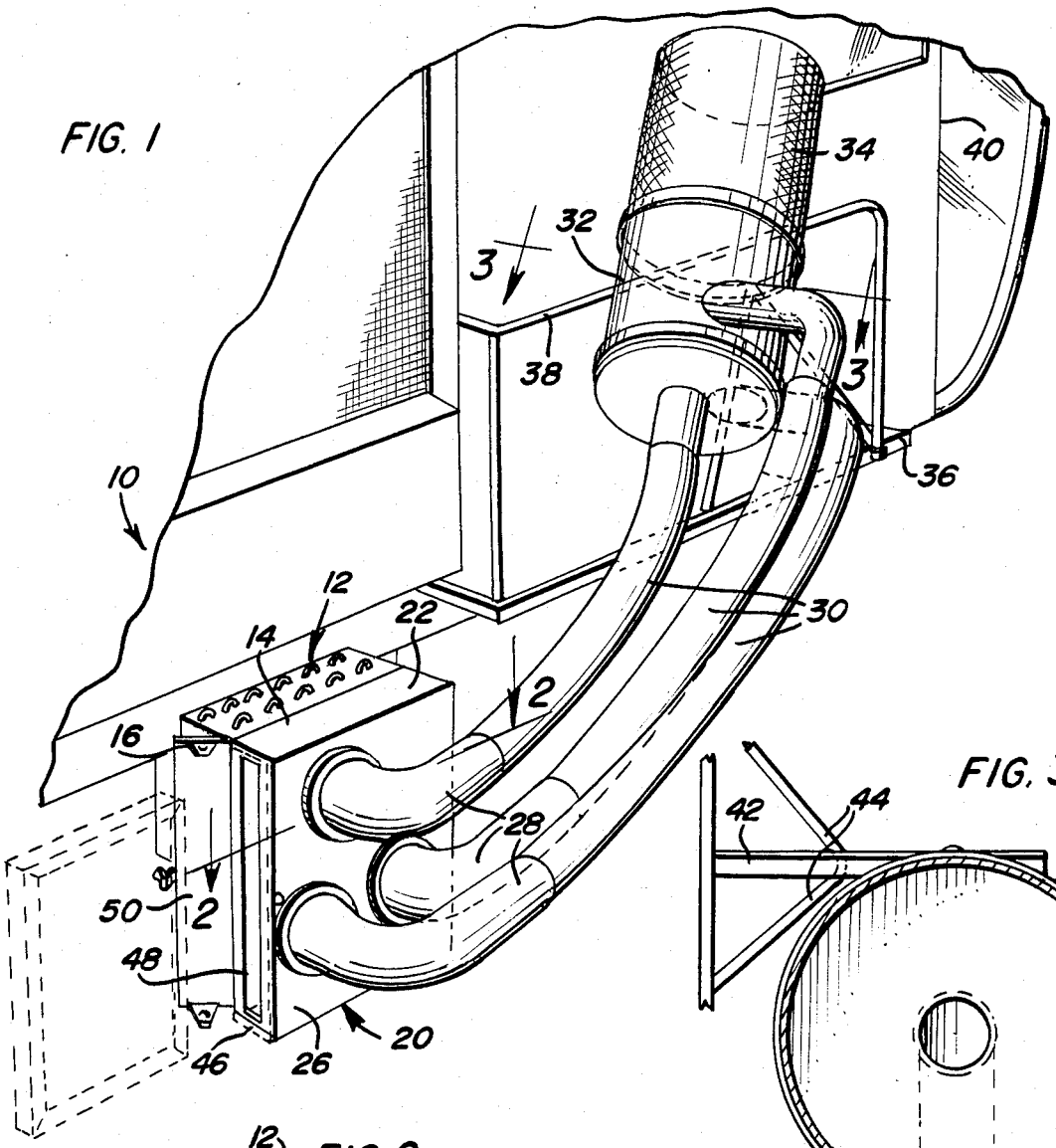
FIG. 1 is a fragmentary right side perspective view of a cotton harvester illustrating the radiator air intake filtering system of the instant invention operatively associated with the radiator of the combustion engine powering the harvester.
Figure 3:
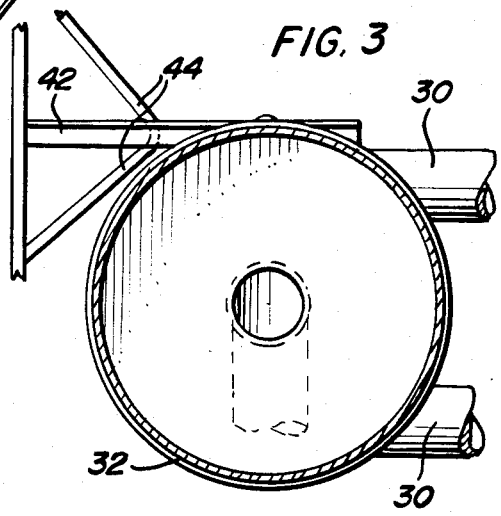
FIG. 3 is an enlarged sectional view taken substantially upon the plane indicated by the section line 3—3 of FIG. 1.

Referring now more specifically to the drawings the numeral 10 generally designates a conventional form of self-propelled cotton harvester such as that manufactured by Allis-Chalmers. The harvester 10 is propelled by a combustion engine having a radiator referred to in general by the reference numeral 12 operatively associated therewith.

The radiator 12 includes an air inlet side 14 and an air outlet side 16 and is disposed at a low elevation adjacent an area in which foreign material including cotton burrs, trash and wisps of cotton lint are discharged from the harvester 10.

The radiator air intake filtering system of the instant invention is referred to in general by the reference numeral 20 and includes a rectangular housing 22 including a first open side 24 and a second side 26 remote from the open side and equipped with a plurality of air inlet fittings 28.

The air inlet fittings have the discharge ends of a plurality of air ducts 30 sealingly communicated therewith in any convenient manner and the inlet ends of the air ducts 30 open into the interior of the lower portion of an air intake body 32 whose upper end is open and has a primary air filter screen 34 operatively associated therewith. The body 32 is removably supported from the platform 36 and railing 38 of the operator's cab 40 of the harvester 10 by suitable support and bracing structures 42 and 44.

Figure 2:
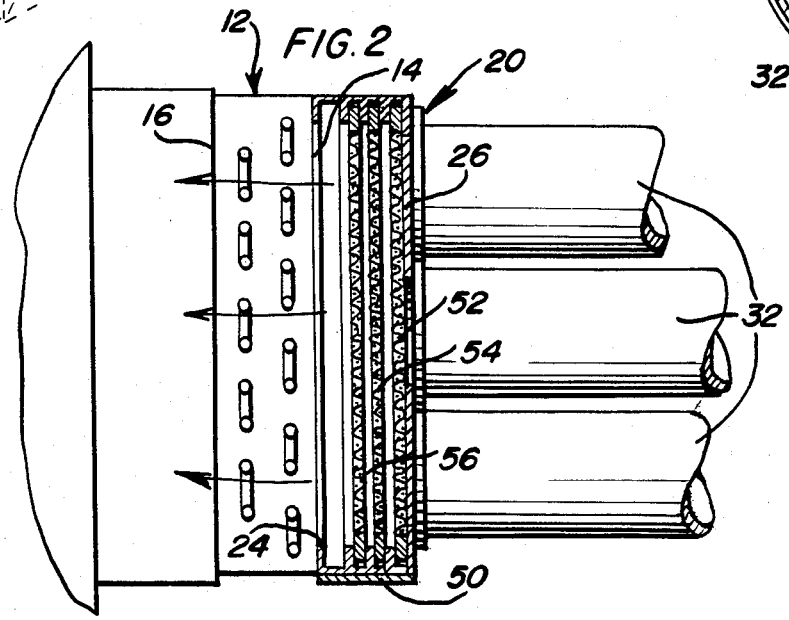
FIG. 2 is an enlarged horizontal sectional view taken substantially upon the plane indicated by the section line 2—2 of FIG. 1.

The housing 22 includes a third side 46 having an access opening 48 formed therein removably closed by a swingable closure 50. Three progressively finer air filter panels 52, 54 and 56 are removably received within the housing 22 through the access opening 48 and, when the closure 50 is in the closed position thereof illustrated in FIG. 2 of the drawings, are operable to filter air passing through the housing 22 from the air inlet fittings 28 through the open side 24. Of course, the air filter panels 52, 54 and 56 are readily removed and replaced or cleaned during a shutdown period of the associated combustion engine of very limited duration. In addition, the external surface of the primary air filter screen 34 may be readily wiped clean of accumulated foreign material.

Thus it may be seen that the radiator air intake filtering system 20 of the instant invention is operative to filter substantially all of the foreign contaminants within cooling air entering the inlet side 14 of the radiator 12 and that the radiator 12 will not become clogged with air borne trash and the like.

The air intake body 32 is supported from the operator's cab area of the harvester 10 in full view of the operator of the harvester and in a location disposed forward of the area from which trash and other air contaminants are ejected or discharged from the harvester 10. In addition, the air intake body 32 is disposed at an elevation considerably above the elevation of the radiator 12 and the air entering the air inlet body 32 is thus cleaner and more free of contaminants than the air immediately adjacent the exterior of the radiator 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an apparatus at least occasionally operative in a dust or trash laden atmosphere, including a liquid cooled combustion engine as a power source and wherein cooling liquid from the engine is passed through a heat transfer assembly in the form of an air cooled radiator including air intake and exhaust sides, an air cleaner for said radiator including a hollow housing having one open side in substantially sealed communication with the intake side of said radiator, said housing including a second side remote from said one side defining air inlet means for said housing, said housing including interior air filter means therein for filtering air passing through said housing from said air inlet means to said open side, air duct means having inlet and outlet ends, said outlet end being sealingly communicated with said air inlet means, said inlet end opening into a hollow air intake structure, said hollow air intake structure including an open side having primary air filtering means operatively associated therewith.

2. The combination of claim 1 wherein said air filter means includes removable air filter elements.

3. The combination of claim 2 wherein said housing includes a third side having an access opening formed therein, a closure removably closing said access opening, said access opening, when said closure is in the open position, providing access to and enabling removal of said removable air filter means.

4. The combination of claim 3 wherein said removable air filter means comprises a plurality of air filter panels of progressively increasing air filtering capacity.

5. The combination of claim 1 wherein said hollow air intake structure is mounted on an elevated portion of said apparatus.

6. The combination of claim 5 wherein said duct means includes flexible duct structure.

7. In combination with an apparatus at least occasionally operative in a dust-laden atmosphere, including a liquid cooled combustion engine as a power source and wherein cooling liquid for said engine is passed through a heat exchange transfer assembly in the form of an air cooled radiator including intake and exhaust sides for cooling air to pass therethrough during absorption of heat from said cooling liquid, a radiator air intake filtering system for said radiator, said system including an air filter element, means removably supporting said air filter element in operative association with said intake side whereby at least substantially all of the air entering the intake side of said radiator must pass through said air filter element, said system including air duct means having inlet and outlet ends, said outlet end of said duct means being supported in operative association with said air filtering element for supplying ambient air to said element for passage therethrough to the intake side of said radiator, the inlet end of said air duct means being supported in elevated position on said apparatus in relation to the elevation of said radiator, said inlet end of said air duct means including primary air filtering means operatively associated therewith.

8. In combination with an apparatus at least occasionally operative in a dust-laden atmosphere and including a combustion engine as a power source and wherein ambient air is passed over heat exchange surfaces for cooling said engine, said apparatus including an intake for said ambient air, an air cleaner for said intake including a hollow housing having one open side in substantially sealed communication with said intake, said housing including a second side remote from said one side defining air inlet means for said housing, said housing including interior air filtering means therein for filtering air passing through said housing from said inlet means to said open side, air duct means having inlet and outlet ends, said outlet end being sealingly communicated with said air inlet means, said inlet end opening into a hollow air intake structure, said hollow air intake structure including an open side having primary air filtering means operatively associated therewith.

* * * * *